US011753274B2

(12) United States Patent
Li et al.

(10) Patent No.: US 11,753,274 B2
(45) Date of Patent: Sep. 12, 2023

(54) METHOD AND SYSTEM FOR MONITORING FAILURE OF ELEVATOR COMMUNICATION MODULE, AND ELEVATOR

(71) Applicant: Otis Elevator Company, Farmington, CT (US)

(72) Inventors: Kai Li, Shanghai (CN); Yang Yang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1009 days.

(21) Appl. No.: 16/596,295

(22) Filed: Oct. 8, 2019

(65) Prior Publication Data

US 2020/0115187 A1 Apr. 16, 2020

(30) Foreign Application Priority Data

Oct. 15, 2018 (CN) ..... 201811195308.0

(51) Int. Cl.

*B66B 1/34* (2006.01)
*B66B 1/06* (2006.01)
*B66B 5/00* (2006.01)

(52) U.S. Cl.

CPC ..... *B66B 1/343* (2013.01); *B66B 1/06* (2013.01); *B66B 1/3453* (2013.01); *B66B 5/0031* (2013.01)

(58) Field of Classification Search

CPC ..... B66B 1/343; B66B 1/06; B66B 1/3453; B66B 5/0031; B66B 5/0018

See application file for complete search history.

(56) References Cited

U.S. PATENT DOCUMENTS 7,000,735 B2 2/2006 Meyer
7,266,505 B2 9/2007 Friedli et al.
(Continued)

FOREIGN PATENT DOCUMENTS

AU 2015217692 A1 9/2016
CN 101102954 A 1/2008
(Continued)

OTHER PUBLICATIONS

Indian Examination Report for Application No. 201914040351; dated Sep. 16, 2020; 6 Pages.
(Continued)

*Primary Examiner* — Jeffrey Donels
(74) *Attorney, Agent, or Firm* — CANTOR COLBURN LLP

(57) ABSTRACT

Methods and systems for monitoring an elevator communication module fault, and elevator systems. The method for monitoring an elevator communication module fault includes acquiring a feedback result in response to sending requests from one or more client ends to the elevator communication module, the elevator communication module being provided for having near-field wireless communication with a client end; counting the number of request failures in the feedback result within a pre-set duration; judging whether the countered number of request failures is not less than a pre-set threshold, and if yes, determining that the elevator communication module has a fault. The invention can quickly and efficiently detect the elevator communication module that has failed, improve elevator passengers' experience, and ensure that the elevator is in excellent operation condition and has a reliable safety performance.

17 Claims, 2 Drawing Sheets

(56) References Cited

U.S. PATENT DOCUMENTS

| | | | |
|---|---|---|---|
| 7,319,967 | B2 | 1/2008 | Meyer |
| 7,319,968 | B2 | 1/2008 | Friedli |
| 2018/0201473 | A1 | 7/2018 | Noxon et al. |

FOREIGN PATENT DOCUMENTS

| | | | |
|---|---|---|---|
| CN | 103708309 | A | 4/2014 |
| CN | 104310135 | A | 1/2015 |
| CN | 104671024 | A | 6/2015 |
| CN | 104876087 | A | 9/2015 |
| CN | 105452138 | A | 3/2016 |
| CN | 105540377 | A | 5/2016 |
| CN | 106276468 | A | 1/2017 |
| CN | 106586747 | A | 4/2017 |
| CN | 106586753 | A | 4/2017 |
| CN | 206069114 | U | 4/2017 |
| CN | 106744111 | A | 5/2017 |
| CN | 106882671 | A | 6/2017 |
| CN | 106911494 | A | 6/2017 |
| CN | 206298231 | U | 7/2017 |
| CN | 206336868 | U | 7/2017 |
| CN | 107055246 | A | 8/2017 |
| CN | 206384672 | U | 8/2017 |
| CN | 206407775 | U | 8/2017 |
| CN | 206447425 | U | 8/2017 |
| CN | 107265230 | A | 10/2017 |
| CN | 206751124 | U | 12/2017 |
| CN | 107572328 | A | 1/2018 |
| CN | 206827845 | U | 1/2018 |
| JP | 2003104644 | A | 4/2003 |
| JP | 2005041674 | A | 2/2005 |
| JP | 2016123027 | A | 7/2016 |
| JP | 2018118813 | A | 8/2018 |
| KR | 20130131616 | A | 12/2013 |

OTHER PUBLICATIONS

Chinese Patent Search for Application CN2018111953080; dated Dec. 13, 2021; 2 Pages.

Junpeng, Liu, "Design requirements for elevator monitoring system based on IoT"; Institution of Information Engineering; Thesis from Wuhan University of Technology; Apr. 2014; 3 Pages.

European Search Report for application EP 19203190.4, dated Mar. 18, 2020, 5 pages.

METHOD AND SYSTEM FOR MONITORING FAILURE OF ELEVATOR COMMUNICATION MODULE, AND ELEVATOR

FOREIGN PRIORITY

This application claims priority to Chinese Patent Application No. 201811195308.0, filed Oct. 15, 2018, and all the benefits accruing therefrom under 35 U.S.C. § 119, the contents of which in its entirety are herein incorporated by reference.

FIELD OF THE INVENTION

The present invention relates to the technical field of elevators, and more particularly to a method and a system for monitoring an elevator communication module fault, and an elevator.

BACKGROUND

Elevators have been widely used in modern society, which can bring great convenience to peoples' work and daily life. Moreover, nowadays many advanced technologies have been applied in various types of elevator products with the rapid development of science and technology. For example, more flexible, convenient and fast elevator scheduling can be realized by using some more intelligent and networked technologies to provide elevators with advanced elevator call systems, such as human-computer interaction via wireless communication, thereby enhancing user experience and satisfaction. However, since these improved elevator systems and the modules, devices or equipment therein have relatively complicated functions and configurations, once a fault occurs, on one hand it may not be easily found out on time, and on the other hand, manpower is required to take time and effort for understanding, troubleshooting and analyzing the fault, which may possibly bring problems such as impairing a good user experience, decreasing the trust to the elevator products, and damaging the interests of the elevator owners.

SUMMARY OF THE INVENTION

In view of the foregoing, the present invention provides a method for monitoring an elevator communication module fault, a system for monitoring an elevator communication module fault, and an elevator, thereby resolving or at least alleviating one or more of the existing problems described above as well as problems of other aspects in the prior art.

Firstly, according to the first aspect of the invention, it is provided a method for monitoring an elevator communication module fault, the elevator communication module being provided for near-field wireless communication with a client end, comprising the steps of: acquiring a feedback result in response to sending requests from one or more client ends to the elevator communication module; counting the number of request failures in the feedback result within a pre-set duration; and judging whether the countered number of request failures is not less than a pre-set threshold, and if yes, determining that the elevator communication module has a fault.

In the method for monitoring an elevator communication module fault according to the invention, optionally, the method further comprises the step of: performing fault treatment on the elevator communication module after determining that the elevator communication module has a fault.

In the method for monitoring an elevator communication module fault according to the invention, optionally, the fault treatment comprises: controlling the elevator communication module to restart; storing the fault information of the elevator communication module; marking the elevator communication module that has been determined to have a fault; and/or sending the fault information of the elevator communication module to a worker and/or a system for managing elevator operation.

In the method for monitoring an elevator communication module fault according to the invention, optionally, the feedback result is transmitted to a server end situated at an elevator locally or a cloud platform, and both the number of request failures is counted, and whether the counted number of request failures is not less than the pre-set threshold is judged, at the server end.

In the method for monitoring an elevator communication module fault according to the invention, optionally, a command to perform fault treatment on the elevator communication module is sent out from the server end after determining that the elevator communication module has a fault.

In the method for monitoring an elevator communication module fault according to the invention, optionally, the elevator communication module has near-field wireless communication with the client end through at least one of BLE, NFC, Wi-Fi, and RF.

In the method for monitoring an elevator communication module fault according to the invention, optionally, the client end includes a mobile terminal.

In the method for monitoring an elevator communication module fault according to the invention, optionally, the request includes an elevator call request, and the elevator call request includes a hall call request and a destination call request.

Additionally, according to the second aspect of the invention, it is provided a system for monitoring an elevator communication module fault, comprising: a data acquisition module configured to acquire a feedback result in response to sending requests from one or more client ends to the elevator communication module; a data processing module connected to the data acquisition module and configured to count the number of request failures in the feedback result within a pre-set duration; and a judging module connected to the data processing module and configured to judge whether the counted number of request failures is not less than a pre-set threshold, and if yes, determine that the elevator communication module has a fault.

In the system for monitoring an elevator communication module fault according to the invention, optionally, the system further comprises a fault treatment module that is connected to the judging module and configured to perform fault treatment on the elevator communication module after the judging module has determined that the elevator communication module has a fault.

In the system for monitoring an elevator communication module fault according to the invention, optionally, the fault treatment comprises: controlling the elevator communication module to restart; storing the fault information of the elevator communication module; marking the elevator communication module that has been determined to have a fault; and/or sending the fault information of the elevator communication module to a worker and/or a system for managing elevator operation.

In the system for monitoring an elevator communication module fault according to the invention, optionally, the fault treatment module is disposed at a server end situated at an elevator locally or a cloud platform, and the command for fault treatment on the elevator communication module is sent out from the server end.

In the system for monitoring an elevator communication module fault according to the invention, optionally, the data acquisition module, the data processing module, and the judging module are all disposed at a server end situated at an elevator locally or a cloud platform.

In the system for monitoring an elevator communication module fault according to the invention, optionally, the elevator communication module has near-field wireless communication with the client end through at least one of BLE, NFC, Wi-Fi, and RF.

In the system for monitoring an elevator communication module fault according to the invention, optionally, the client end includes a mobile terminal.

In the system for monitoring an elevator communication module fault according to the invention, optionally, the request includes an elevator call request, and the elevator call request includes a hall call request and a destination call request.

Additionally, according to the third aspect of the invention, it is provided an elevator which comprises a system for monitoring an elevator communication module fault according to any one of the systems described above.

From the following descriptions in combination with the drawings, one will clearly understand the principles, characteristics, features and advantages of the various technical solutions of the present invention. For example, the technical solutions of the invention have, as compared with the prior art, obvious technical advantages: it can quickly and efficiently detect the elevator communication module that has a fault, and it can also utilize various means of fault treatment to solve the problem, thereby effectively reducing or eliminating the adverse effects caused by the failure of the elevator communication module, improving elevator passengers' experience, and ensuring that the elevator is in excellent operation condition and has a reliable safety performance.

BRIEF DESCRIPTION OF THE DRAWINGS

The technical solutions of the present invention will be further described in detail below in conjunction with the drawings and embodiments. However, it should be understood that the drawings are designed merely for illustrative purpose and are intended only to conceptually explain the configurations described herein. It is unnecessary to draw the drawings in proportion.

DETAILED DESCRIPTION OF THE INVENTION

First, it should be noted that the steps, configurations, features, and advantages of the method for monitoring an elevator communication module fault, the system for monitoring an elevator communication module fault and the elevator in accordance with the present invention will be described hereinafter by way of examples. None of the descriptions, however, should be construed, in any way, as limiting the scope of the invention.

Moreover, as for any single technical feature described or implied in the embodiments mentioned herein, or any single technical feature described or implied in the various figures, the present invention still allows any further combination or deletion of these technical features (or equivalents thereof) without any technical obstacle, and therefore it should be considered that more of such embodiments according to the invention are also within the scope of the disclosure contained in the application. In the disclosure, the technical terms " . . . end", " . . . module" and the like include components, devices or equipment that may be implemented by hardware such as a processor, software, or a combination thereof.

Figure 1:
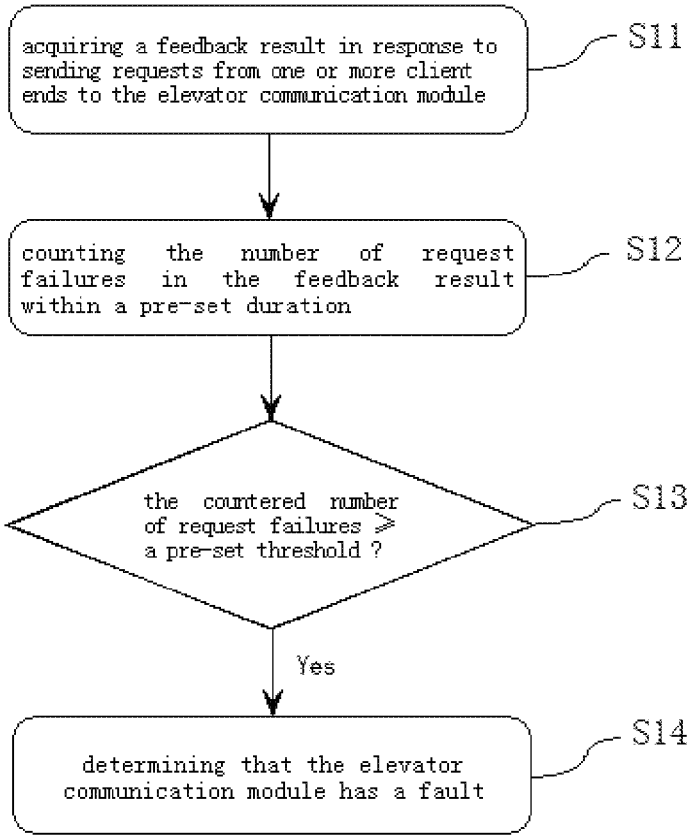
FIG. 1 is a flow diagram of an embodiment of a method for monitoring an elevator communication module fault in accordance with the invention.
Figure 2:
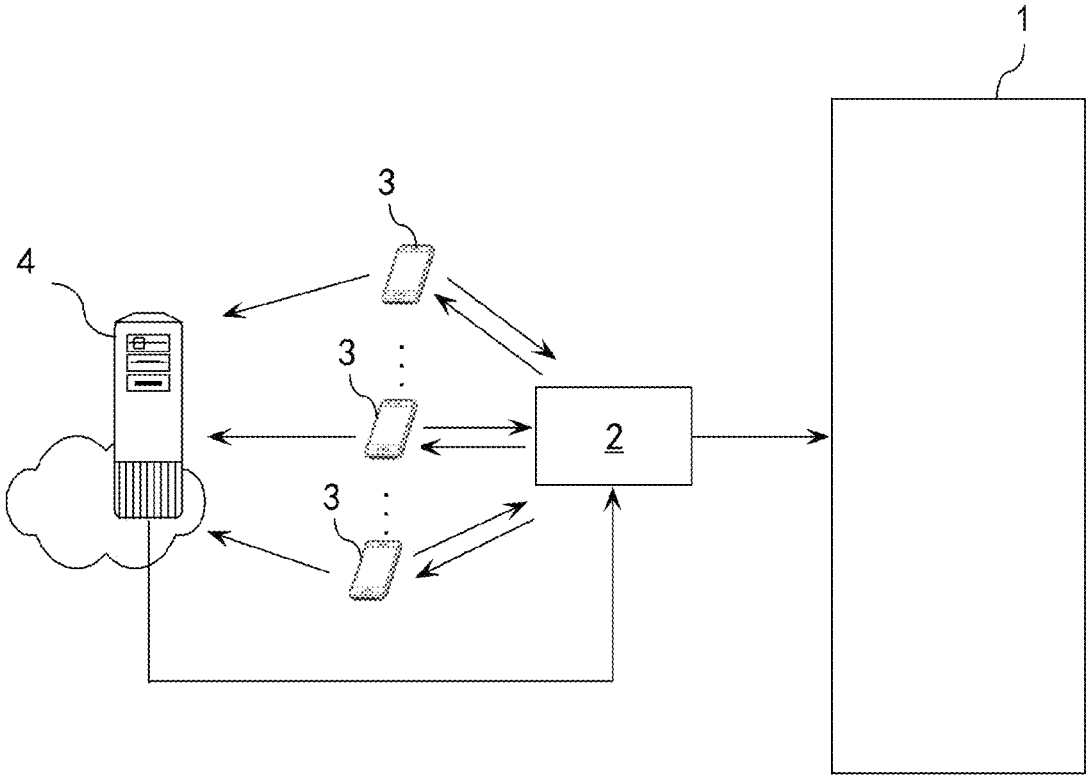
FIG. 2 is a schematic diagram of an application scenario of an embodiment of a method for monitoring an elevator communication module fault in accordance with the invention.

Referring to FIGS. 1 and 2, an embodiment of a method for monitoring an elevator communication module fault according to the invention is presented. By way of example, this method embodiment may comprise the following steps: First, at step S11, a feedback result is obtained in response to requests sent from one or more client ends to the elevator communication module.

Specifically, as shown in FIG. 2, the elevator communication module 2 is provided for having near-field wireless communication with the client end 3. That is, different users such as individual elevator passengers, elevator maintenance workers, etc., may have human-computer interaction with the elevator communication module 2 through their client ends 3, and the elevator communication module 2 will acquire the various requests of the users, transmit the requests to the corresponding functional module(s) (e.g. the elevator scheduling system, the elevator controller, etc.) of the elevator 1 via wired communication and/or wireless communication for the corresponding processing, and then feeds the processing result back to the client end 3 that made the corresponding request.

FIG. 2 exemplarily shows a plurality of client ends 3, which may be a mobile terminal such as a cell phones, a tablet computer, etc., and may also be, for example, a fixed terminal arranged in elevator halls or in elevator waiting areas on other floors. By means of such a client end 3, one may have near-field wireless communication with the elevator communication module 2 of the elevator 1 for data information interaction. That is, as shown in FIG. 2, a user may send out a request via the uplink from the client end 3 to the elevator communication module 2 (e.g. an elevator call request such as a hall call request, a destination call request, etc.).

When the elevator communication module 2 is in a normal working state, it will transmit the feedback result given by the elevator 1 in response to the above request(s) to the corresponding client end(s) 3 via the downlink from the elevator communication module 2 to the client end 3, as illustrated in FIG. 2.

However, if the elevator communication module 2 has a fault that causes its malfunction, the data transmission through the above-mentioned uplink and/or downlink will fail (for example, it may appear specifically as an uplink timeout, a downlink timeout, garbled or invalid data received by the client end 3 or the elevator communication module 2, etc.), and such a feedback result of request failure can be finally reflected at the client end 3 that sent the corresponding request.

It should be noted that the near-field wireless communication between the elevator communication module 2 and the client end 3 may be carried out by various means, including but not limited to, BLE (Bluetooth Low Energy), NFC (Near-field Communication), RF (Radio Frequency), Wi-Fi, etc. Put it in another way, in practical applications, the elevator communication module 2 referred to herein may also be referred to as a BLE module/unit, an NFC module/unit, etc. Hence, the elevator communication module 2 completely encompasses them and other modules, units or devices that have similar functions.

In addition, it should be understood that in actual applications one elevator 1 may be provided with one or more elevator communication modules 2, and multiple elevators 1 may also share one elevator communication module 2 at the same time. The specific number of installations, installation positions and the like of the elevator communication module 2 in the present invention may all be flexibly configured according to the actual application requirements.

Still referring to FIG. 1, at step S12, the number of request failures in the feedback result(s) in a pre-set duration (which may be set flexibly in accordance with the actual applications, e.g. 10 minutes, 30 minutes, 60 minutes, 90 minutes, 12 hours, 24 hours, or any other suitable values) can be counted based on the above-described feedback result(s) from one or three client ends 3 (i.e. it can be a feedback result obtained after one client end 3 sent multiple requests to one elevator communication module 2, or it can be a feedback result obtained after two or more than two client ends 3 each sent one or more requests to one elevator communication module 2), and the number of request failures will be used for analysis and judgement of whether the elevator communication module 2 has a fault.

At step S13, it is judged whether the counted number of request failures obtained in the above step S12 is not less than a pre-set threshold, and if yes, then at step S14 the elevator communication module 2 is determined to have a fault. That is, the elevator communication module 2 shows a lack of ability to normally and reasonably handle users' requests, and therefore it can be concluded that the elevator communication module 2 has a fault; otherwise, it is determined that the elevator communication module 2 is still operating normally at the time being. With respect to the pre-set threshold described above, the present invention allows flexible setting, changing, and adjustment according to actual applications without departing from the spirit of the present invention. For example, the pre-set threshold may be set to 3 times, 5 times, 10 times, 15 times or any other suitable values.

By adopting the approaches described above, one or more elevator communication modules 2 of one or more elevators 1 can be monitored very conveniently for their respective working status, and the elevator communication module 2 that has a fault can be detected and located efficiently, quickly and accurately, thereby effectively reducing the time needed to find and solve the fault, helping to improve elevator passengers' experience, and reducing or eliminating the various adverse effects that may be caused by the fault of the elevator communication module.

Optionally, in some embodiments of the method according to the present invention, the method may further include the step of fault treatment on the elevator communication module 2 after determining that the elevator communication module 2 has a fault. Specifically, such fault treatment may be performed in a variety of ways to better meet different application requirements, for example, in one or more of the following ways: controlling the elevator communication module to restart, so that the elevator communication module may possibly restore to normal operation by means of such a restart; storing the fault information of the elevator communication module. Such fault information may include the location of the elevator communication module, the fault determination time, the number of request failures, etc., and the fault information may help the project maintenance personnel, technology developers, manufacturer, etc. to further analyze and locate the fault, and to improve the quality of the elevator communication module and other related components, devices or equipment; marking the elevator communication module that was determined to have a fault, thereby helping distinguish between an elevator communication module that currently works normally and the elevator communication module that was determined to have failed, so that, for example, an elevator management system can divide duties among these elevator communication modules to therefore ensure and improve the performance of the elevator system; sending the fault information of the elevator communication module to a worker and/or the system for managing the elevator operation, so that the relevant personnel can be arranged to arrive at the scene as soon as possible or remote control can be used to remove the fault of the elevator communication module.

Referring to FIG. 2, optionally, the request feedback result obtained, for example, at one or more client ends 3 may be transmitted to the server end 4 as exemplarily shown in this figure. The server end 4 may be disposed at an elevator locally or it can be disposed at a cloud platform, and such server end 4 is used to count the number of request failures as described above and to analyze and determine if the counted number of request failures is not less than the pre-set threshold. In addition, optionally, a command for performing fault treatment on the elevator communication module 2 as described above may be sent out from the server end 4 after determining that the elevator communication module 2 has a fault so as to effectively reduce or eliminate the various adverse effects that may occur due to the elevator communication module fault.

Figure 3:
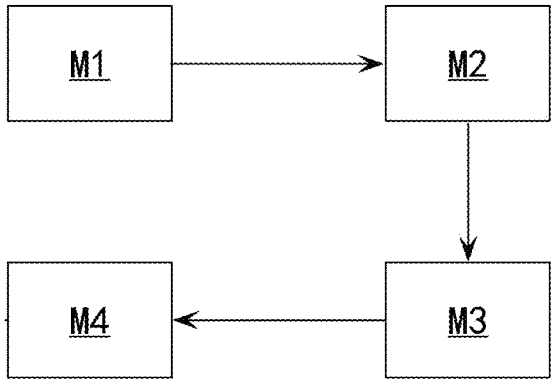
FIG. 3 is a block diagram of an embodiment of a system for monitoring an elevator communication module fault in accordance with the invention.

In order to better understand the technical solutions of the present invention, as an exemplary example, a general composition of a system embodiment for monitoring an elevator communication module fault according to the present invention is also shown in FIG. 3, including a data acquisition module M1, a data processing module M2, a judging module M3 and a fault treatment module M4.

As shown in FIG. 3, in this embodiment the data acquisition module M1 is configured to acquire the feedback results in response to requests sent from one or more client ends to the elevator communication module, and these feedback results can be obtained from the various client ends described above.

The data processing module M2 is connected to the above-mentioned data acquisition module M1 to count the number of request failures in the feedback result within a pre-set duration.

The judging module M3 is connected to the data processing module M2 to judge whether the counted number of failures is not less than a pre-set threshold, and if so, it can be determined that the elevator communication module has a fault.

The fault treatment module M4 is connected to the judging module M3 for troubleshooting the elevator communication module after the judging module M3 has determined that the elevator communication module has a fault. It should be noted that the above-mentioned fault treatment module M4 may not be provided necessarily in some embodiments.

Optionally, the data acquisition module M1, the data processing module M2, the judging module M3, and the fault treatment module M4 may all be disposed on the server end 4 as shown in FIG. 2, and the server end 4 may be arranged directly at the elevator locally, or it can be arranged at a cloud platform.

It can be understood that one can directly refer to the specific descriptions of the corresponding parts in the forgoing discussions and no repetition is made herein, since detailed descriptions have been given with respect to the technical contents such as the elevator communication module, client end, server end, near-field wireless communication, pre-set duration, pre-set threshold, and the fault treatment approaches when discussing the method for monitoring an elevator communication module fault according to the invention with reference to the embodiments shown in FIG. 1 and FIG. 2.

Because the methods and systems for monitoring an elevator communication module fault in accordance with the invention have the technical advantages remarkably superior than the prior art as discussed above, they are highly suitable to be applied in elevator systems so as to overcome the shortcomings and deficiencies existing in the prior art including those described hereinbefore.

For example, an elevator is provided in another technical solution according to the invention. The elevator system is provided with a system for monitoring an elevator communication module fault designed and provided in accordance with the invention, for example, the system for monitoring an elevator communication module fault may be integrated into an elevator controller or other suitable components, devices, equipment or system in the elevator, thereby achieving the remarkably superior technical advantages of the technical solutions according to the invention as described above.

The methods for monitoring an elevator communication module fault, the systems for monitoring an elevator communication module fault, and the elevators in accordance with the invention have been exemplified in detail by way of example only. The examples are merely illustrative of the principles of the invention and its embodiments and are not intended to limit the invention. Various modifications and improvements can be made by those skilled in the art without departing from the spirit and scope of the invention. Therefore, all equivalent technical solutions should be considered and construed to be within the scope of the invention and are defined by the accompanying claims.

What is claimed is:

1. A method for monitoring an elevator communication module fault, the elevator communication module being provided for near-field wireless communication with a client end, wherein the method comprises:

acquiring a feedback result in response to sending requests from one or more client ends to the elevator communication module;

counting the number of request failures in the feedback result within a pre-set duration; and judging whether the countered number of request failures is not less than a pre-set threshold, and if yes, determining that the elevator communication module has a fault.

2. The method for monitoring an elevator communication module fault according to claim 1, wherein the method further comprises:

performing fault treatment on the elevator communication module after determining that the elevator communication module has a fault.

3. The method for monitoring an elevator communication module fault according to claim 2, wherein the fault treatment comprises at least one of:

controlling the elevator communication module to restart;

storing the fault information of the elevator communication module;

marking the elevator communication module that has been determined to have a fault; and sending the fault information of the elevator communication module to at least one of a worker and a system for managing elevator operation.

4. The method for monitoring an elevator communication module fault according to claim 1, wherein the feedback result is transmitted to a server end situated at an elevator locally or a cloud platform, and both the number of request failures is counted, and whether the counted number of request failures is not less than the pre-set threshold is judged, at the server end.

5. The method for monitoring an elevator communication module fault according to claim 4, wherein a command to perform fault treatment on the elevator communication module is sent out from the server end after determining that the elevator communication module has a fault.

6. The method for monitoring an elevator communication module fault according to claim 1, wherein the elevator communication module has near-field wireless communication with the client end through at least one of BLE, NFC, Wi-Fi, and RF.

7. The method for monitoring an elevator communication module fault according to claim 1, wherein the client end includes a mobile terminal.

8. The method for monitoring an elevator communication module fault according to claim 1, wherein the request includes an elevator call request, and the elevator call request includes a hall call request and a destination call request.

9. A system for monitoring an elevator communication module fault, characterized in that the system:

a data acquisition module configured to acquire a feedback result in response to sending requests from one or more client ends to the elevator communication module;

a data processing module connected to the data acquisition module and configured to count the number of request failures in the feedback result within a pre-set duration; and a judging module connected to the data processing module and configured to judge whether the counted number of request failures is not less than a pre-set threshold, and if yes, determine that the elevator communication module has a fault.

10. The system for monitoring an elevator communication module fault according to claim 9, wherein the system further comprises a fault treatment module that is connected to the judging module and configured to perform fault treatment on the elevator communication module after the judging module has determined that the elevator communication module has a fault.

11. The system for monitoring an elevator communication module fault according to claim 10, wherein the fault treatment comprises at least one of:

controlling the elevator communication module to restart;

storing the fault information of the elevator communication module;

marking the elevator communication module that has been determined to have a fault; and sending the fault information of the elevator communication module to at least one of a worker and a system for managing elevator operation.

12. The system for monitoring an elevator communication module fault according to claim 10, wherein the fault treatment module is disposed at a server end situated at an elevator locally or a cloud platform, and the command for fault treatment on the elevator communication module is sent out from the server end.

13. The system for monitoring an elevator communication module fault according to claim 9, wherein the data acquisition module, the data processing module, and the judging module are all disposed at a server end situated at an elevator locally or a cloud platform.

14. The system for monitoring an elevator communication module fault according to claim 9, wherein the elevator communication module has near-field wireless communication with the client end through at least one of BLE, NFC, Wi-Fi, and RF.

15. The system for monitoring an elevator communication module fault according to claim 9, wherein the client end includes a mobile terminal.

16. The system for monitoring an elevator communication module fault according to claim 9, wherein the request includes an elevator call request, and the elevator call request includes a hall call request and a destination call request.

17. An elevator, characterized in that the elevator comprises a system for monitoring an elevator communication module fault according to claim 9.

* * * * *